US007024723B2

(12) United States Patent
Vandenbelt et al.

(10) Patent No.: US 7,024,723 B2
(45) Date of Patent: Apr. 11, 2006

(54) DUSTER CLEANING MEMBER FOR A VACUUM CLEANER

(75) Inventors: Rudy A. Vandenbelt, Ottawa (CA); Troy G. Anderson, Marblehead, MA (US); Bjarki Hallgrimsson, Ottawa (CA)

(73) Assignee: Headwaters R&D, Inc., Ottawa (CA)

( * ) Notice: Subject to any disclaimer, the term of this patent is extended or adjusted under 35 U.S.C. 154(b) by 263 days.

(21) Appl. No.: 10/243,289

(22) Filed: Sep. 13, 2002

(65) Prior Publication Data

US 2003/0079309 A1 May 1, 2003

Related U.S. Application Data

(63) Continuation-in-part of application No. 09/882,782, filed on Jun. 15, 2001, now Pat. No. 6,530,114.

(60) Provisional application No. 60/322,390, filed on Sep. 14, 2001.

(51) Int. Cl.
*A47L 5/36* (2006.01)
*A47L 9/02* (2006.01)

(52) U.S. Cl. ..... 15/310; 15/246.2; 15/415.1

(58) Field of Classification Search ..... 15/246.2, 15/310, 328, 393, 394, 403, 415.1
See application file for complete search history.

(56) References Cited

U.S. PATENT DOCUMENTS

| | | | | |
|---|---|---|---|---|
| 1,714,346 | A | 5/1929 | Carleton | |
| 1,799,833 | A | 4/1931 | Swanson | |
| 1,934,144 | A | 11/1933 | Reiser | |
| 2,031,374 | A | 2/1936 | Liedtke et al. | |
| 2,033,672 | A | 3/1936 | Baker | |
| 2,304,193 | A | 12/1942 | Nielsen | |
| 2,331,457 | A | 10/1943 | Curtis | |
| 2,437,340 | A * | 3/1948 | Zugehoer | 15/310 |
| 2,475,815 | A | 7/1949 | Burd | |
| 2,499,183 | A | 2/1950 | Fairgrieve | |
| 2,519,254 | A | 8/1950 | Kersky | |
| 2,526,485 | A | 10/1950 | Koitick | |
| 2,623,230 | A | 12/1952 | Feinen | |
| 2,625,704 | A | 1/1953 | Cudy | |
| 2,718,655 | A * | 9/1955 | Cymara | 15/310 |
| 2,724,856 | A | 11/1955 | Conkey | |
| 2,764,776 | A | 10/1956 | Peguero | |
| 2,927,338 | A * | 3/1960 | Burton | 15/302 |
| 3,217,349 | A | 11/1965 | Hull et al. | |
| 4,296,523 | A * | 10/1981 | Clark | 15/415.1 |
| 5,020,186 | A | 6/1991 | Lessig, III et al. | |
| 5,230,722 | A | 7/1993 | Yonkers | |
| 5,265,628 | A | 11/1993 | Sage et al. | |
| 5,305,495 | A | 4/1994 | Nelson et al. | |
| 5,586,358 | A | 12/1996 | Wolfe et al. | |
| 5,655,253 | A | 8/1997 | Nevin et al. | |
| 6,101,666 | A | 8/2000 | Cheng | |
| 6,145,162 | A | 11/2000 | Deutschenbaur et al. | |
| 6,341,402 | B1 | 1/2002 | Lindquist et al. | |

(Continued)

FOREIGN PATENT DOCUMENTS

EP 1106131 A3 6/2001

*Primary Examiner*—Terrence R. Till
(74) *Attorney, Agent, or Firm*—Albert Peter Durigon

(57) ABSTRACT

A duster cleaning member derives its suction power from a vacuum cleaner to which it is operatively coupled. A duster made of any material received thereby is cleaned by the filtration system of the vacuum cleaner which captures the dust and exhausts cleaned air back into the home or office environment.

18 Claims, 6 Drawing Sheets

U.S. PATENT DOCUMENTS 6,530,114 B1 * 3/2003 Bailey et al. ..... 15/310
2001/0002499 A1 * 6/2001 Lindquist et al. ..... 15/310
2002/0046437 A1 4/2002 Bailey et al.
2003/0101531 A1 * 6/2003 Bailey et al. ..... 15/310

* cited by examiner

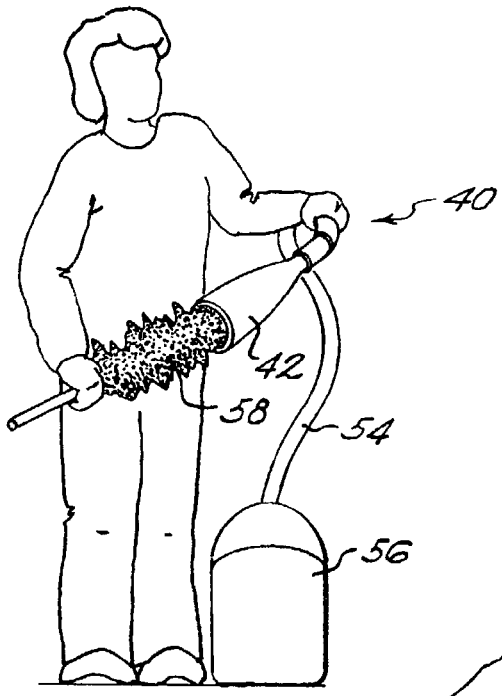
FIG. 3A
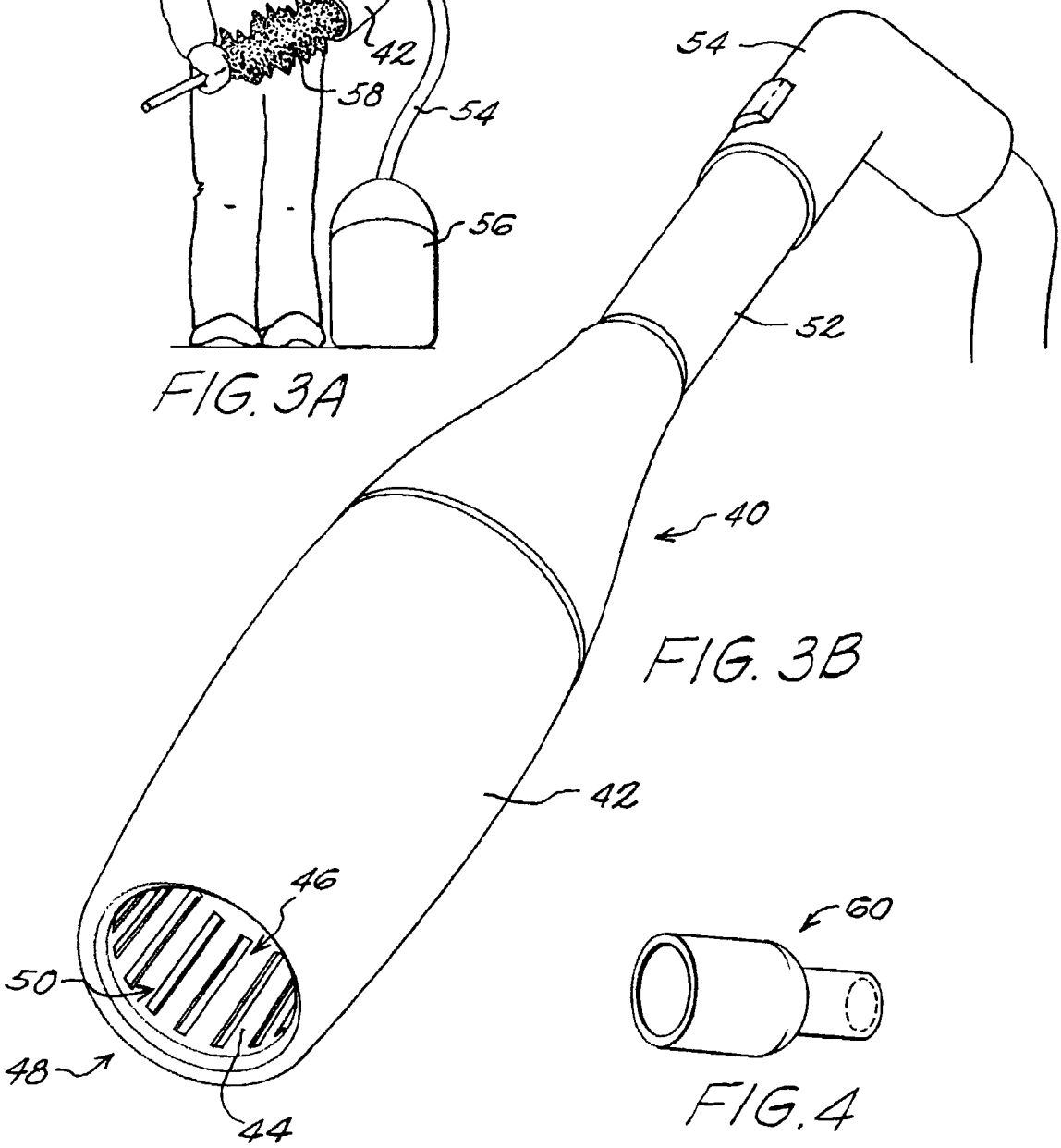
FIG. 3B
FIG. 4

DUSTER CLEANING MEMBER FOR A VACUUM CLEANER

CROSS-REFERENCE TO RELATED APPLICATIONS

This invention is a continuation-in-part application of allowed U.S. application Ser. No. 09/882,782, filed Jun. 15, 2001 now U.S. Pat. No. 6,530,114.

This application claims the benefit of Provisional Application 60/322,390 filed Sep. 14, 2001.

FIELD OF THE INVENTION

This invention is drawn to the field of foreign matter removal, and more particularly, to a novel duster cleaning member for a vacuum cleaner.

BACKGROUND OF THE INVENTION

Vacuum cleaners for the home and office are typically configured either full-sized or as hand-held vacuum cleaners. The full-sized units typically include upright, canister and, among others, the stick-Vac. Hand-held vacuum cleaners are typically configured as wet and/or dry models that are either cordless or corded.

In general, all such units include a vacuum source, a power unit, a filtration system and an orifice in fluid communication with the vacuum source via the filtration system. The full-sized models typically include a hose and/or cleaning head, while the forward end of the hand-held vacuum cleaners is typically fashioned with a nozzle, which defines the cleaning orifice.

Various attachments, such as extension wands, crevice tools and upholstery brushes adapted to mate with the orifices of the hand-held vacuum cleaners and hoses of the full-sized units have been devised in the effort to provide more effective dirt, liquid spillage and dust pick-up, but the heretofore known attachments have had their utility limited to the removal of dirt and other foreign matter from floors, upholstery and other surfaces.

SUMMARY OF THE INVENTION

The present invention in one of its broad objects contemplates a duster receiving member utilizing the suction power and filtration system of a vacuum cleaner to which it is operatively coupled that enables to provide effective, substantially pollution-less cleaning of dusters received thereby.

The present invention in another of its broad objects contemplates such a duster receiving member utilizing the suction power and filtration system of a vacuum cleaner to which it is operatively coupled that enables to provide effective cleaning of household or office feather or lambswool or other dusters or dust wands received thereby.

In various embodiments, the vacuum cleaner includes a housing and the duster receiving member is fashioned as a fixed or removable part of the vacuum cleaner's housing; the vacuum cleaner includes a detachable hose and the duster receiving member is operatively coupled to the detachable hose; the vacuum cleaner includes a nozzle defining a cleaning orifice and the duster receiving member is operatively coupled to the cleaning orifice of the vacuum cleaner; and the vacuum cleaner includes a cleaning orifice in fluid communication with the filtration system along a flow path, and the duster receiving member is operatively coupled to the vacuum cleaner at a place along the flow path intermediate the cleaning orifice and the filtration system. The duster receiving member may be free-standing or hand-holdable, and may be fashioned to at least partially surround or to substantially wholly receive the dusters to be cleaned thereby. The duster receiving members may be integrally formed with or removably attached to the housings, hoses or nozzles defining cleaning orifices of the vacuum cleaners whose suction power and filtration system they utilize. Fittings for the removably attached duster receiving members that accommodate varying standard hose sizes and nozzle dimensions may be employed. The fittings may be flexible or rigid, male or female and of fixed or variable lengths. The invention has application to any type of full-sized and/or hand-held vacuum cleaners.

BRIEF DESCRIPTION OF THE DRAWINGS

These and other objects, inventive aspects and advantageous features of the present invention will become apparent as the invention becomes better understood by referring to the following, slowly exemplary detailed description of the presently preferred embodiments, and to the drawings, wherein:

FIG. 3 illustrates in the FIG. 3A thereof a pictorial view showing the use of a hand-holdable duster receiving member for a full-sized canister vacuum cleaner and in the FIG. 3B thereof a pictorial view of the hand-holdable duster receiving member operatively coupled to the hose of a full-sized canister vacuum cleaner;

FIG. 4 is a pictorial view showing an adapter for the hand-holdable duster receiving member of the embodiment of FIG. 3 that accommodates different hose sizes of standard full-sized vacuum cleaners;

DETAILED DESCRIPTION OF THE PRESENTLY PREFERRED EMBODIMENTS

Figure 1A:
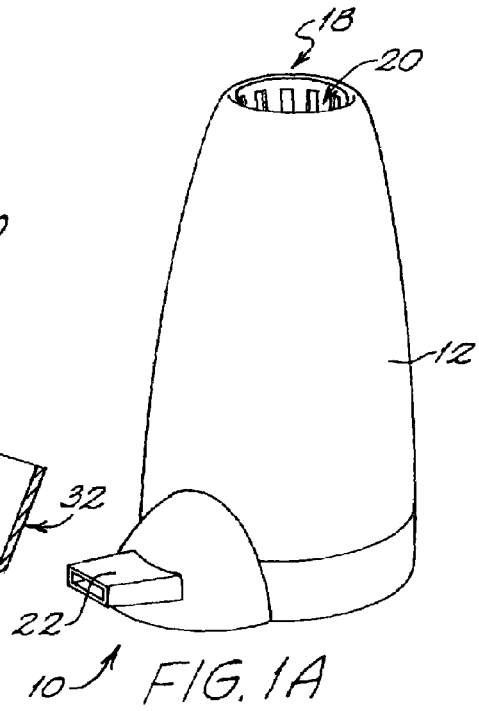
FIG. 1 illustrates in the FIG. 1A thereof a front pictorial view of a free-standing duster receiving member for a hand-held vacuum cleaner and illustrates in the FIG. 1B thereof a pictorial side sectional view of the free-standing duster receiving member operatively coupled to a hand-held vacuum cleaner.
Figure 1B:
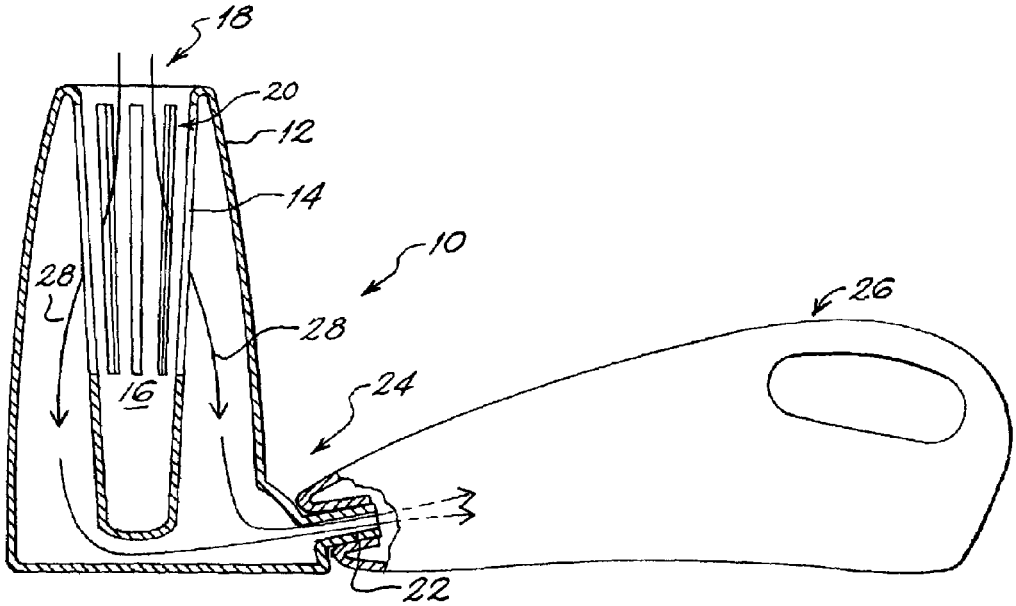

Referring now to FIGS. 1A and 1B, generally designated at 10 is a free-standing duster receiving member for a hand-held vacuum cleaner in accord with the present invention. The free-standing duster receiving member 10 includes a free-standing housing 12 having a sleeve 14 defining an internal chamber generally designated 16 adapted to receive a duster. The sleeve 14 includes a mouth generally designated 18 through which the duster is inserted into the chamber 16, and longitudinally extending openings generally designated 20, disposed radially circumferentially about the sleeve 14, through which foreign matter is drawn off of the duster inserted in the chamber 16. The free-standing duster receiving member includes a fitting 22 adapted to mate with the nozzle generally designated 24 of a hand-held vacuum cleaner generally designated 26 that is in fluid communication with the chamber 16 provided by the sleeve 14 through the openings 20 thereof. Although a sleeve with longitudinal openings is presently preferred, any means providing a duster receiving chamber in fluid communication with the nozzle may be employed. Any suitable means for providing pressure equalization circumferentially about the chamber 16 and any suitable means for dislodging foreign matter off of the duster inserted into the sleeve 14 may be employed. The fitting 22, although it is preferably rigid and of fixed length and adapted for nozzle insertion in the illustrated embodiment, may be fashioned of rigid or flexible material of fixed or variable length and otherwise adapted to mate with the nozzle. Preferably, the free-standing duster receiving member is fashioned of plastic, as are all embodiments herein described, although-other materials could be employed.

In use, the suction provided by the hand-held vacuum cleaner 26 draws air through the mouth 18 past a duster, not shown, received in the chamber 16 of the sleeve 14 entraining foreign matter, which air with entrained foreign matter is drawn radially through the openings 20 peripherally about the duster and through the fitting 22 into the nozzle 24 and filtration system of the hand-held vacuum cleaner 26 as schematically illustrated by arrows 28, thereby effectively removing foreign matter accumulated on the duster.

Figure 2:
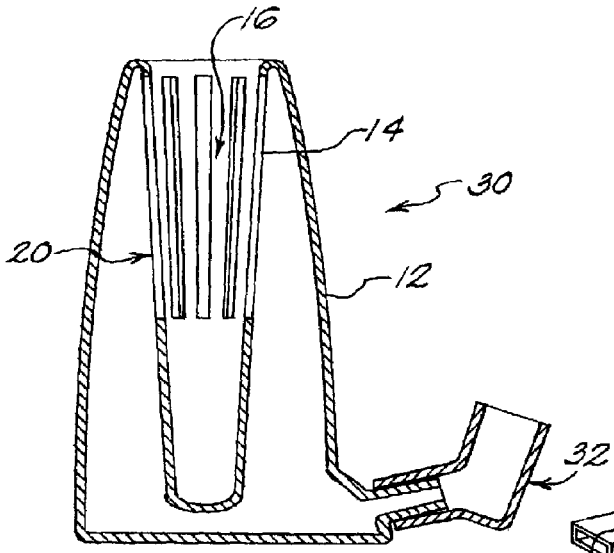
FIG. 2 illustrates a pictorial side sectional view of another embodiment of a free-standing duster receiving member in accord with the present invention for a full-sized vacuum cleaner.

Referring now to FIG. 2, generally designated at 30 is another embodiment of a free-standing duster receiving member in accord with the present invention for a full-sized vacuum cleaner. The free-standing duster receiving member 30 includes housing 12, sleeve 14 having longitudinally extending openings 20, disposed radially circumferentially thereabout, and internal chamber 16, as in the embodiment 10 of FIG. 1, and differs therefrom in that it includes a fitting generally designated 32 adapted to mate with the hose of a full-sized (upright or canister) vacuum cleaner, not shown. In operation of the embodiment 30, foreign matter is removed from dusters received in the chamber 16 thereof in the same way as foreign matter is removed from dusters received in the chamber 16 of the embodiment of FIG. 1. It enjoys the advantage provided by AC power typically employed to operate full-sized vacuum cleaners, as do some hand-held vacuum cleaners. Any duster receiving member configured to be free-standing, and any suitable means providing a duster receiving chamber, fluid communication, pressure equalization, foreign matter dislodgment, and/or hose interfacing may be employed without departing from the inventive concepts.

Referring now to FIGS. 3A and 3B, generally designated at 40 is a hand-holdable duster receiving member for a full-sized canister vacuum cleaner in accord with the present invention. The hand-holdable duster receiving member 40 includes a hand-holdable housing 42 having a sleeve 44 defining an internal chamber generally designated 46 adapted to receive a duster. The sleeve 44 includes a mouth generally designated 48 through which the duster is inserted into the chamber 46, and longitudinally extending openings generally designated 50 through which foreign matter is drawn radially peripherally about the duster inserted in the chamber 46. The hand-holdable duster receiving member includes a fitting 52 adapted to mate with the hose 54 of a full-sized canister vacuum cleaner 56 that is in fluid communication with the chamber 46 provided by the sleeve 44 through the openings 50 thereof. Any suitable means for providing pressure equalization circumferentially about the chamber 46 and any suitable means for dislodging foreign matter off of the duster inserted into the sleeve 44 may be employed. The fitting 52 although preferably rigid and of fixed length in the illustrated embodiment, may be fashioned of rigid or flexible material of fixed or variable length, and, as illustrated generally at 60 in FIG. 4, it may be provided with an end adapted to accommodate varying standard hose sizes. Any duster receiving member adapted to be hand-holdable, and any suitable means providing a duster receiving chamber, fluid communication and/or hose interfacing may be employed without departing from the inventive concepts.

In use, the suction provided by the full-sized canister vacuum cleaner 56 draws air through the mouth 48 radially peripherally through openings 50 about a duster 58, received in the chamber 46 of the sleeve 44, entraining foreign matter, which air with entrained foreign matter is drawn radially through the openings 50 peripherally about the duster 58 and through the fitting 52 into the hose 54 and therewith the filtration system of the full-sized canister vacuum cleaner 56, thereby effectively removing foreign matter accumulated on the duster 58.

Figure 5A:
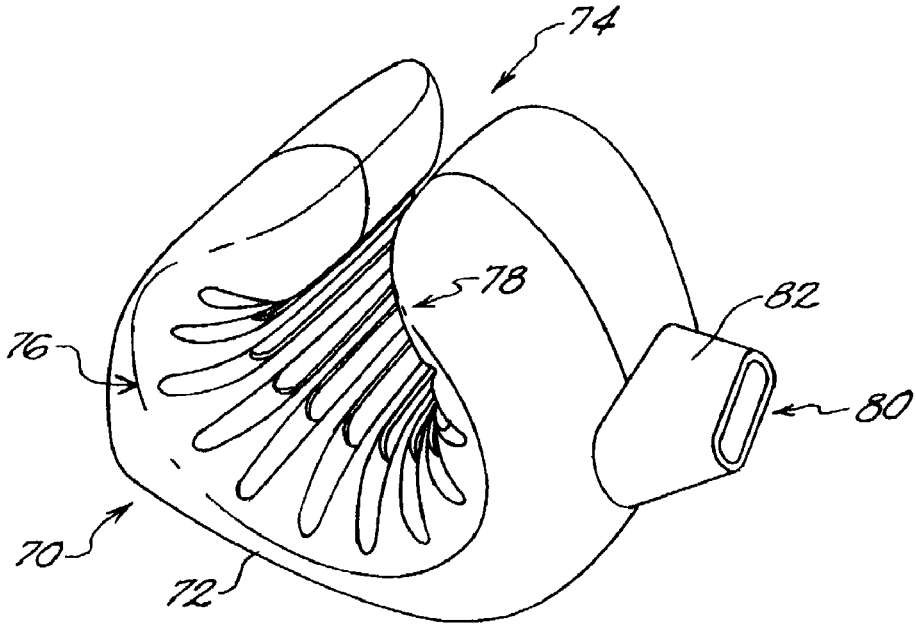
FIG. 5 illustrates in the FIG. 5A thereof a pictorial view of a hand-holdable duster receiving member for a hand-held vacuum cleaner and illustrates in the FIG. 5B thereof pictorial views illustrating the manner it is used in removing foreign matter from dusters received thereby.

Referring now to FIG. 5A, generally designated at 70 is a hand-holdable duster receiving member for a hand-held vacuum cleaner in accord with the present invention. The hand-holdable duster receiving member 70 includes a hand-holdable housing 72 that is substantially "C-shaped" defining a longitudinally extending slot generally designated 74 adapted to receive a duster. The hand-holdable duster receiving member 70 includes a plurality of dust-guide and agitation channels generally designated 76 provided circumferentially about the inside face of the "C-shaped" hand-holdable housing 72 that lead into a respective one of a plurality of longitudinally extending openings generally designated 78, centrally provided circumferentially about the inside face of the "C-shaped" hand-holdable housing 72, which are in fluid communication with orifice generally designated 80 of fitting 82 adapted to mate with a hand-held vacuum cleaner. Any suitable means for providing pressure equalization circumferentially about the housing 72 and any suitable means for dislodging foreign matter off of the duster inserted thereinto may be employed. The fitting 82, although preferably rigid and of fixed length adapted for nozzle insertion in the illustrated embodiment, may be fashioned of rigid or flexible material of fixed or variable length, and may be provided with a different end otherwise adapted to mate with the nozzle and/or a fitting adapted to accommodate varying standard nozzle sizes. Although a substantially "C-shaped" duster receiving member with central openings and dust guides is presently preferred, any hand-holdable duster receiving member that at least partially receives a duster having openings in fluid communication with the nozzle and/or dust agitation and flow control members of any suitable configuration may be employed.

Figure 5B:
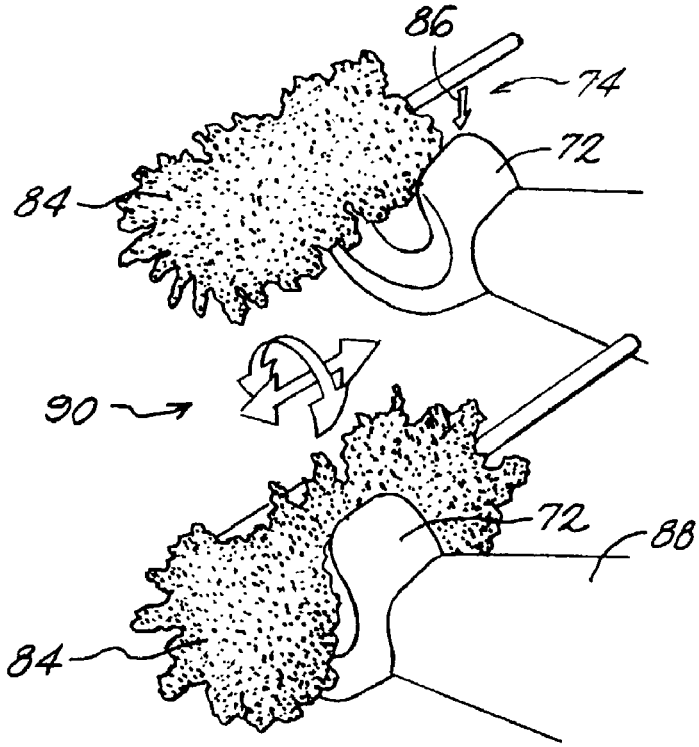

In use, and referring now to FIGS. 5A and 5B, a duster 84 is inserted into the hand-holdable housing 72 through the slot 74 thereof as schematically illustrated by arrow 86, and the suction provided by the hand-held vacuum cleaner 88 draws air radially peripherally through the openings 78 of the hand-holdable housing 72. As the duster 84 is rolled and longitudinally moved as schematically illustrated by arrows generally designated 90, foreign matter dislodged therefrom is captured in the dust-guide channels 76, is entrained in the air drawn through the openings 78 and is moved therewith through orifice 80 of fitting 82 into the filtration system of the hand-held vacuum cleaner 88, thereby effectively removing foreign matter accumulated on the duster 84.

Figure 6:
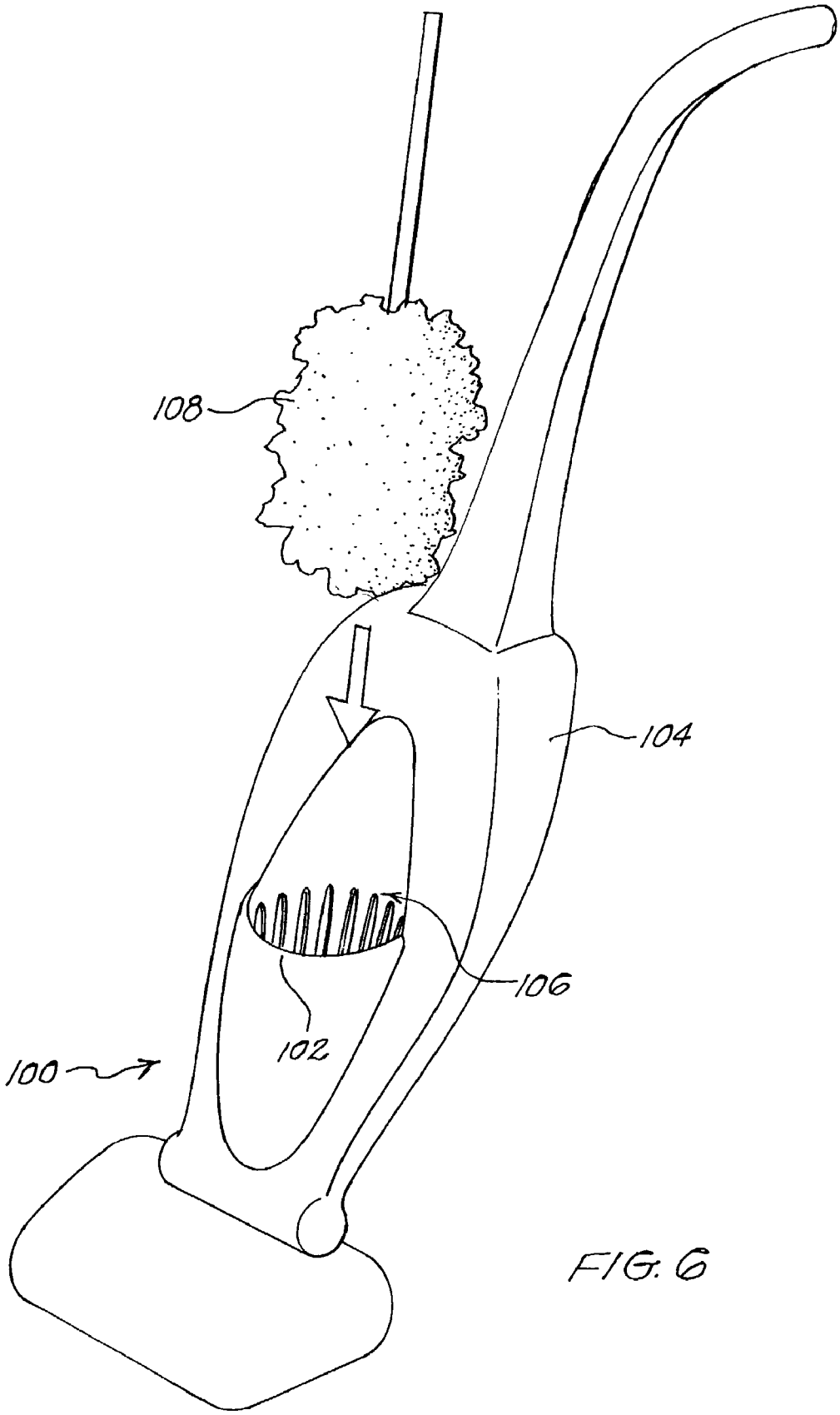
FIG. 6 illustrates a pictorial view of a duster receiving member in accord with the present invention integrally formed as part of a full-sized upright vacuum cleaner.

Referring now to FIG. 6, generally designated at 100 is a pictorial view of a duster receiving member in accord with the present invention integrally formed as part of a full-sized upright vacuum cleaner. The duster receiving member 100 includes a housing 102 adapted to receive a duster formed as part of the housing of a full-sized upright vacuum cleaner 104. A plurality of slots generally designated 106 are provided in the housing 102 in fluid communication with the vacuum source via the filtration system of the upright vacuum cleaner 104 that draw air radially peripherally about the duster received therewithin. A valve or other means, not shown, is provided to controllably connect the vacuum source of the vacuum cleaner to its cleaning head or the slots 106 selectively. Any suitable means for providing pressure equalization circumferentially about the housing 102 may be employed, and any suitable means for dislodging foreign matter off of a duster 106 inserted thereinto may be employed. Although a duster receiving member adapted to receive a duster integrally formed at the front of a full-sized upright vacuum cleaner is presently preferred, the duster receiving member may be formed at the rear or side and/or detachable to upright or canister or other vacuum cleaners and/or configured to at least partially receive a duster could be employed without departing from the inventive concepts.

In use, the duster 108 is inserted in the housing 102 and air moving radially peripherally past the duster 108 entrains foreign matter therein, which air with entrained foreign matter is drawn through the openings 106 and into the filtration system of the upright vacuum cleaner 104, thereby effectively removing foreign matter accumulated on the duster 108.

Figure 7:
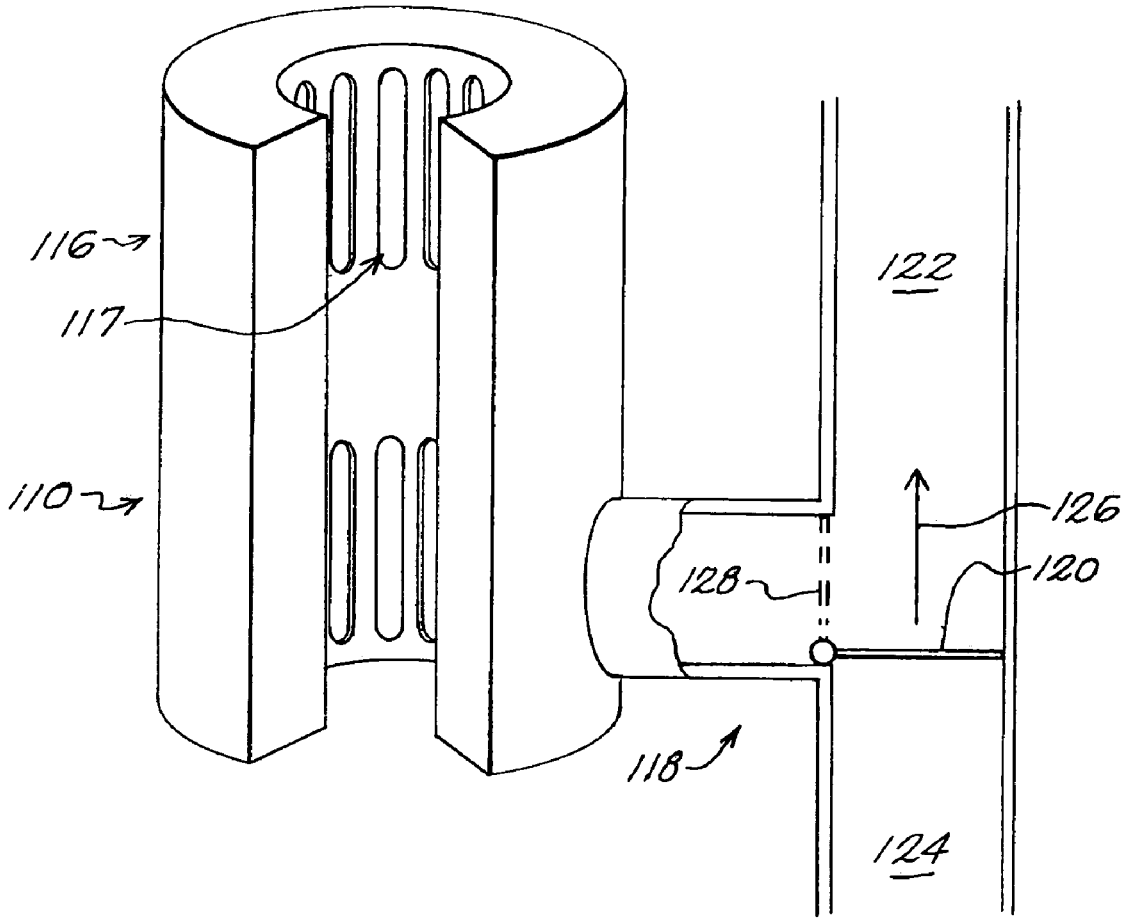
FIG. 7 illustrates a pictorial view of a duster receiving member in accord with the present invention having a member by which it is attached to one of an upright vacuum cleaner, a canister vacuum cleaner, and a flexible hose of an upright vacuum cleaner and canister vacuum cleaner.

Referring now to FIG. 7, generally designated at 110 is a pictorial view of a duster receiving member in accord with the present invention having a member by which it is attached to one of an upright vacuum cleaner, a canister vacuum cleaner, and a flexible hose of an upright vacuum cleaner and canister vacuum cleaner. The duster receiving member 110 includes a C-shaped housing generally designated 116 adapted to receive a duster and a member generally designated 118 formed as part of the housing 116 (or attachable thereto) by which it is attached to one of an upright vacuum cleaner, a canister vacuum cleaner, and a flexible hose of an upright vacuum cleaner and canister vacuum cleaner. A plurality of slots generally designated 117 are provided radially peripherally about the housing 116. The member 118 includes a valve 120 connecting the C-shaped housing 116 in the flow path schematically illustrated by arrow 126 between the vacuum source generally designated 122 and the orifice generally designated 124 of one of an upright vacuum cleaner, a canister vacuum cleaner, and a flexible hose of an upright vacuum cleaner and canister vacuum cleaner at a point therealong upstream of the filtration system, not shown. Any suitable means for providing pressure equalization circumferentially about the housing 116 may be employed, and any suitable means for dislodging foreign matter off of a duster inserted thereinto may be employed. Although a duster receiving member adapted to receive a duster integrally formed with the attaching member is presently preferred, the attaching member may be detachable without departing from the inventive concepts.

In use, and with the valve 120 in its open position illustrated in solid outline, air moving radially peripherally past the duster entrains foreign matter therein, which air with entrained foreign matter is drawn through the attaching member 118 and into the filtration system of the upright or canister vacuum cleaner, thereby effectively removing foreign matter accumulated on the duster. With the valve 120 in its closed position illustrated in dashed outline 128, the vacuum cleaner operates in its normal manner. As will be readily appreciated by those of skill in the art, the attaching member may be mounted in different embodiments to the housing and/or hose of an upright or canister vacuum cleaner without departing from the inventive concepts.

Figure 8B:
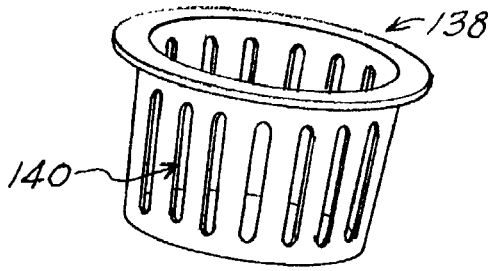
FIG. 8 illustrates in the FIG. 8A thereof a pictorial view of another embodiment of a duster receiving member in accord with the present intention having a member by which it is attached to one of an upright vacuum cleaner, a canister vacuum cleaner, and a flexible hose of an upright vacuum cleaner and canister vacuum cleaner and illustrates in the FIG. 8B thereof a slotted ring member thereof.
Figure 8A:
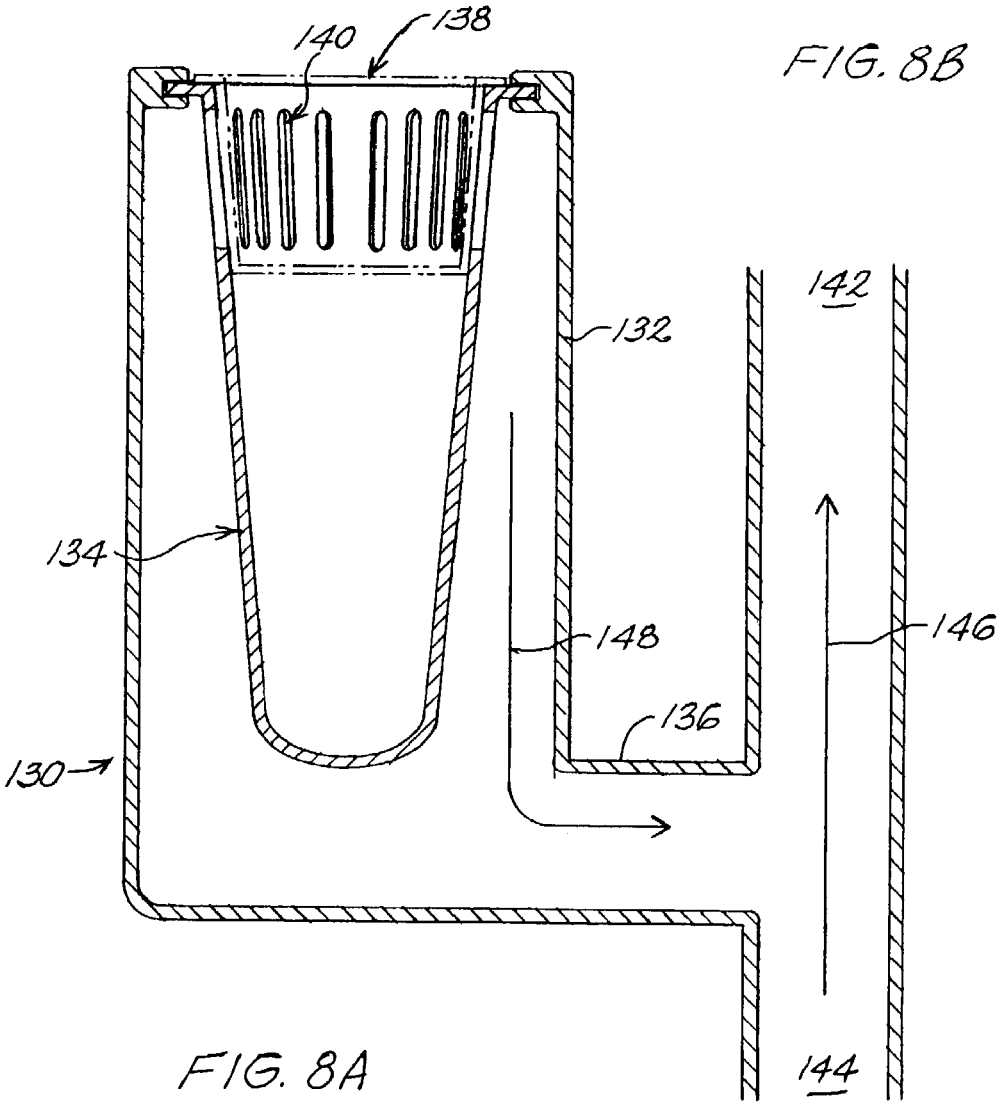

Referring now to FIG. 8, generally designated at 130 is a pictorial view of another embodiment of a duster receiving member in accord with the present invention having a member by which it is attached to one of an upright vacuum cleaner, a canister vacuum cleaner, and a flexible hose of an upright vacuum cleaner and canister vacuum cleaner. The duster receiving member 130 includes a housing 132 adapted to receive a sleeve generally designated 134, and an attaching member 136 formed as part of the housing 132 (or attachable thereto). A slotted ring generally designated 138, best seen in FIG. 8B, having a plurality of slots generally designated 140 radially peripherally about the ring is mounted for rotation in the sleeve 134. The sleeve 134 has a like plurality of slots, not shown. The member 136 connects the housing in the flow path schematically illustrated by arrow 146 between the vacuum source generally designated 142 and the orifice generally designated 144 of one of an upright vacuum cleaner, a canister vacuum cleaner, and a flexible hose of an upright vacuum cleaner and canister vacuum cleaner at a point therealong upstream of the filtration system, not shown. Any suitable means for providing pressure equalization circumferentially about the housing 132 may be employed, and any suitable means for dislodging foreign matter off of a duster inserted into the sleeve 134 may be employed. Although a duster receiving member adapted to receive a duster integrally formed with the attaching member is presently preferred, the attaching member may be detachable without departing from the inventive concepts.

In use, and with ring 138 rotated to bring the slots 140 in open alignment with the slots provided on the sleeve 134, air moving radially circumferentially past the duster entrains foreign matter therein, which air with entrained foreign matter is drawn through the attaching member 136, as schematically illustrated by arrow 148, and into the filtration system of the upright or canister vacuum cleaner, thereby effectively removing foreign matter accumulated on the duster. With the ring 138 rotated in position where the slots 140 are not in alignment with the slots provided on the sleeve 134, no air is moved through the sleeve 134 and the vacuum cleaner operates in its normal manner. As will be readily appreciated by those of skill in the art, the attaching member may be mounted in different embodiments to the housing and/or hose of an upright or canister vacuum cleaner without departing from the inventive concepts.

Many modifications and alternative embodiments of the present invention will become apparent to those of skill in the art who have benefitted from the instant disclosure.

What is claimed is:

1. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said duster receiving member is a free-standing canister having a sleeve adapted to receive said duster to be cleaned; and said openings are provided radially circumferentially about said sleeve.

2. The duster cleaning member of claim 1, wherein said vacuum cleaner is a hand-held vacuum cleaner having a nozzle which defines said cleaning orifice upstream of said filtration system; and wherein said canister is adapted for fluid communication with said nozzle.

3. The duster cleaning member of claim 1, wherein said vacuum cleaner is one of a canister vacuum cleaner and an upright vacuum cleaner having a detachable hose having a free end which defines said cleaning orifice upstream of said filtration system; and wherein said canister is adapted for fluid communication with said free end of said detachable hose.

4. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said duster receiving member is a hand-holdable housing having a sleeve adapted to receive said duster to be cleaned; said sleeve having a wall defining a longitudinal axis and at least partially surrounding said duster to be cleaned, said wall having longitudinally spaced end portions and a middle portion between said longitudinally spaced end portions; and said openings are provided in radially spaced apart relation circumferentially about said middle portion of said sleeve such that said air is drawn radially about at least a major portion of the periphery of said duster to be cleaned in a direction that is generally perpendicular to said longitudinal axis substantially along said middle portion of said wall between said longitudinal ends.

5. The duster cleaning member of claim 4, wherein said vacuum cleaner is one of a canister vacuum cleaner and an upright vacuum cleaner having a detachable hose having a free end which defines said cleaning orifice upstream of said filtration system; and wherein said hand-holdable housing includes a fitting adapted to mate with said free end of said detachable hose with the result that the hand-holdable housing and hose are removably attachable via said fitting.

6. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said vacuum cleaner is a canister vacuum cleaner having a cleaning orifice; and wherein said duster cleaning member includes an attaching member attaching the same to said canister vacuum cleaner in fluid communication with said flow path at a preselected point selected intermediate said cleaning orifice and said filtration system;

wherein said duster receiving member is a generally C-shaped member having an arcuate wall adapted to surround at least a major portion of the periphery of said duster to be cleaned; wherein said openings are provided radially circumferentially about said arcuate wall of said C-shaped member of said duster receiving member; and wherein said attaching member includes a valve.

7. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said vacuum cleaner is a canister vacuum cleaner having a cleaning orifice; and wherein said duster cleaning member includes an attaching member attaching the same to said canister vacuum cleaner in fluid communication with said flow path at a preselected point selected intermediate said cleaning orifice and said filtration system;

wherein said duster receiving member is a canister having a sleeve adapted to receive said duster to be cleaned; wherein said openings are provided radially circumferentially about said sleeve; and further including a slotted ring rotatably mounted in said canister rotatable to bring its slots selectably in alignment with said openings.

8. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said vacuum cleaner is an upright vacuum cleaner having a cleaning orifice; and wherein said duster receiving member includes an attaching member attaching the same to said upright vacuum cleaner in fluid communication with said flow path at a preselected point selected intermediate said cleaning orifice and said filtration system;

wherein said duster receiving member is a generally C-shaped member having an arcuate wall adapted to surround at least a major portion of the periphery of said duster to be cleaned; wherein said openings are provided radially circumferentially about said arcuate wall of said C-shaped member of said duster receiving member; and wherein said attaching member includes a valve.

9. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said vacuum cleaner is an upright vacuum cleaner having a cleaning orifice; and wherein said duster receiving member includes an attaching member attaching the same to said upright vacuum cleaner in fluid communication with said flow path at a preselected point selected intermediate said cleaning orifice and said filtration system;

wherein said duster receiving member is a canister having a sleeve adapted to receive said duster to be cleaned; wherein said openings are provided radially circumferentially about said sleeve; and further including a slotted ring rotatably mounted in said canister rotatable to bring its slots selectably in alignment with said openings.

10. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

said vacuum cleaner is one of a canister vacuum cleaner and an upright vacuum cleaner having a detachable hose having a length and a free end; and wherein said duster receiving member includes an attaching member attaching the same to said detachable hose in fluid communication with said flow path at a preselected point selected intermediate said free end and said filtration system;

wherein said duster receiving member is a generally C-shaped member having an arcuate wall adapted to surround at least a major portion of the periphery of said duster to be cleaned; wherein said openings are provided radially circumferentially about said arcuate wall of said C-shaped member of said duster receiving member; and wherein said attaching member includes a valve.

11. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

said vacuum cleaner is one of a canister vacuum cleaner and an upright vacuum cleaner having a detachable hose having a length and a free end; and wherein said duster receiving member includes an attaching member attaching the same to said detachable hose in fluid communication with said flow path at a preselected point selected intermediate said free end and said filtration system;

wherein said duster receiving member is a canister having a sleeve adapted to receive said duster to be cleaned;

wherein said openings are provided radially circumferentially about said sleeve; and further including a slotted ring rotatably mounted in said canister rotatable to bring its slots selectably in alignment with said openings.

12. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said duster receiving member is a generally C-shaped member having an arcuate wall adapted to surround at least a major portion of the periphery of said duster to be cleaned; wherein said openings are provided radially circumferentially about said arcuate wall of said C-shaped member of said duster receiving member;

further including at least one member coupled to said C-shaped member adapted to provide dust agitation and flow control about at least a major portion of the peripherally of said duster to be cleaned.

13. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said duster receiving member is a generally C-shaped member having an arcuate wall adapted to surround at least a major portion of the periphery of said duster to be cleaned; wherein said openings are provided radially circumferentially about said arcuate wall of said C-shaped member of said duster receiving member;

wherein said vacuum cleaner is a hand-held vacuum cleaner having a nozzle which defines said cleaning orifice upstream of said filtration system; and wherein said C-shaped member is adapted for fluid communication with said nozzle.

14. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said duster receiving member is a generally C-shaped member having an arcuate wall adapted to surround at least a major portion of the periphery of said duster to be cleaned; wherein said openings are provided radially circumferentially about said arcuate wall of said C-shaped member of said duster receiving member;

wherein said vacuum cleaner is a canister vacuum cleaner having a cleaning orifice; and wherein said C-shaped member includes an attaching member attaching the same to said canister vacuum cleaner in fluid communication with said flow path at a preselected point selected intermediate said cleaning orifice and said filtration system.

15. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said duster receiving member is a generally C-shaped member having an arcuate wall adapted to surround at least a major portion of the periphery of said duster to be cleaned; wherein said openings are provided radially circumferentially about said arcuate wall of said C-shaped member of said duster receiving member;

wherein said vacuum cleaner is an upright vacuum cleaner having a cleaning orifice; and wherein said C-shaped member includes an attaching member attaching the same to said upright vacuum cleaner in fluid communication with said flow path at a preselected point selected intermediate said cleaning orifice and said filtration system.

16. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said duster receiving member is a generally C-shaped member having an arcuate wall adapted to surround at least a major portion of the periphery of said duster to be cleaned; wherein said openings are provided radially circumferentially about said arcuate wall of said C-shaped member of said duster receiving member;

wherein said vacuum cleaner is one of a canister vacuum cleaner and an upright vacuum cleaner having a detachable hose having a length and a free end; and wherein said C-shaped member includes an attaching member attaching the same to said detachable hose in fluid communication with said flow path at a preselected point selected intermediate said free end and said filtration system.

17. A duster cleaning member for a vacuum cleaner having a vacuum source, a power unit, a filtration system and a cleaning orifice in fluid communication with the vacuum source via the filtration system along a flow path, said duster cleaning member comprising:

a member receiving a duster to be cleaned adapted for fluid communication with said flow path at a preselected point selected upstream of said filtration system of said vacuum cleaner;

said member receiving a duster to be cleaned having openings adapted to draw air radially about at least a major portion of the periphery of said duster to be cleaned that are in fluid communication with said flow path, whereby, foreign matter, entrained in the air radially drawn about at least a major portion of the periphery of the duster to be cleaned, is removed by said filtration system of said vacuum cleaner;

wherein said vacuum cleaner is an upright vacuum cleaner; wherein said duster receiving member includes a housing coupled with the upright vacuum cleaner; and wherein said openings are provided radially circumferentially about at least major portion of the periphery of said housing.

18. The duster cleaning number of claim 17, wherein said housing of said duster receiving member is integrally formed with said upright vacuum cleaner.

* * * * *